US009514608B2

(12) United States Patent
Casey et al.

(10) Patent No.: US 9,514,608 B2
(45) Date of Patent: Dec. 6, 2016

(54) METHOD, APPARATUS, AND PROGRAM PRODUCT PROVIDING A PLAYER SELECTION WAGERING GAME WITH ESCALATING PRIZES

(71) Applicant: EVERI GAMES INC., Austin, TX (US)

(72) Inventors: Michael Casey, Austin, TX (US); Clint Owen, Austin, TX (US)

(73) Assignee: Everi Games Inc., Austin, TX (US)

( * ) Notice: Subject to any disclaimer, the term of this patent is extended or adjusted under 35 U.S.C. 154(b) by 233 days.

(21) Appl. No.: 14/192,546

(22) Filed: Feb. 27, 2014

(65) Prior Publication Data

US 2015/0243134 A1 Aug. 27, 2015

(51) Int. Cl.
*G07F 17/32* (2006.01)

(52) U.S. Cl.
CPC ..... *G07F 17/3244* (2013.01); *G07F 17/3262* (2013.01)

(58) Field of Classification Search
USPC ..... 463/20, 23, 25, 30
See application file for complete search history.

(56) References Cited

U.S. PATENT DOCUMENTS

| | | | | |
|---|---|---|---|---|
| 6,309,300 | B1 | 10/2001 | Glavich | |
| 8,231,451 | B2 | 7/2012 | Englman et al. | |
| 8,308,545 | B2 | 11/2012 | Gomez et al. | |
| 2009/0124361 | A1* | 5/2009 | Gilmore | 463/26 |

* cited by examiner

*Primary Examiner* — Dmitry Suhol
*Assistant Examiner* — Barndon Gray
(74) *Attorney, Agent, or Firm* — Nathan Calvert, Esq.; Russell D. Culbertson, Esq.; J P Cody, Esq.

(57) ABSTRACT

Methods and gaming systems provide a player selection game in which the prizes available in the game increase in response to certain player selections from the various player selectable elements. Prizes are increased in a manner that makes it clear to the player that they have obtained an enhanced prize. In particular, prizes are increased in the course of the player selection game so that the lowest prize available after a prize increase is greater than the highest prize available prior to the prize increase.

20 Claims, 12 Drawing Sheets

METHOD, APPARATUS, AND PROGRAM PRODUCT PROVIDING A PLAYER SELECTION WAGERING GAME WITH ESCALATING PRIZES

TECHNICAL FIELD OF THE INVENTION

A gaming method includes a player selection arrangement where a player selection from a number of selectable elements may cause a modification in a prize set defined for a remaining number of player selections. The invention also includes a gaming system operable to perform the gaming method and a program product storing program code which is executable on suitable hardware to perform the gaming method.

BACKGROUND OF THE INVENTION

Wagering games may include features which increase player participation and provide for enhanced payouts in order to maintain player interest and provide a more enjoyable gaming experience. One of the ways to provide for player participation is to include a player selection game in the wagering game. Player selection games display a number of graphic elements which are each selectable by the player. Although the player selectable elements are displayed anonymously with respect to any prize, some of the player selectable elements may be associated with a respective prize value. Being "displayed anonymously" in this sense means that each player selectable element is displayed without an indication of the particular prize or other game result associated with that player selectable element. The player is given one or more opportunities to select one of the player selectable elements and the player is awarded any prize associated with their selections.

Although player participation games such as player selection games are widely known, there remains a need in the art to provide ways to capture and maintain a player's interest. Maintaining the player's interest and providing more player engagement and excitement encourages additional play and enhances the player's overall gaming experience.

SUMMARY OF THE INVENTION

Embodiments of the present invention provide a player selection game in which the prizes available in the game increase in response to certain player selections from the various player selectable elements. Prizes are increased in a manner that makes it clear to the player that they have obtained an enhanced prize. The arrangement increases player excitement by increasing the anticipation associated with making player selections and avoids the disappointment associated with awarding prizes that are not clearly enhanced.

A method according to the present invention may include anonymously displaying a number of player selectable elements through a display system of a gaming machine. Each player selectable element is associated with a respective selection game result in a player selection game. At least one of the selection game results comprises a respective prize value included in a first set of prize values, and at least one selection game result comprises a prize modification result. With the various player selectable elements anonymously displayed, that is, displayed so that it is not apparent to the player what if any prize will be paid for selection of a given player selectable element, the method includes receiving a number of player selection inputs through a player input system of the gaming machine. Each respective player selection input selects one of the player selectable elements which has not yet been selected for that instance of the player selection game. In response to each player selection input, the method may include displaying the selection game result and any correlated prize value associated with the player selectable element selected with that player selection input. However, when the player selects a player selectable element associated with the prize modification result, the method includes performing a modification to modify the prize value associated with each player selectable element which has not yet been selected in that instance of the game. Responsive to this first modification, the prize value associated with each respective player selectable element which has not yet been selected in the game is modified so as to be included in a second set of prize values made up of prize values which are each greater than the highest prize value included in the first set of prize values. For each player selectable element the player selects in the course of the game, the player is awarded the prize value associated with that player selectable element at the time the element is selected.

In this process the prizes available to be awarded in the game increase in response to a selection which obtains the prize modification result. Further, the available prizes increase so that once the prize modification result has been obtained it is not possible for a player to obtain a prize equal to or lower than a prize included in the first set of prize values. Thus it is readily apparent to the player that the prizes after the modification have been increased, and the player suffers no disappointment at receiving a prize which was increased, but still within the prize range defined by the first set of prize values.

In some embodiments of the invention it is possible for the player to select a second player selectable element associated with the prize modification result. In response to such a selection, a method according to the invention may include performing a second modification to modify the prize value associated with each respective player selectable element which has not yet been selected. Responsive to this second modification the prize value associated with each respective player selectable element which has not yet been selected is modified so as to be included in a third set of prize values made up of prize values which are each greater than the highest prize value included in the second set of prize values. Further modifications are also possible, with each additional modification modifying the prize value associated with each respective player selectable element which has not yet been selected so that responsive to that additional modification, the prize value associated with each respective player selectable element which has not yet been selected is greater than the highest prize value produced by the immediately preceding modification.

Some embodiments of the present invention may include displaying different prize categories, with each prize category associated with the number of prize modification results the player has obtained for that instance of the player selection game. These prize categories may be displayed concurrently or at least partially concurrently with displaying the number of player selectable elements for the player selection game. Each displayed prize category in some forms of the invention includes an indication of a number of prize modification results obtained by the player in the player selection game and a list of the prize values available when that number of prize modification results have been obtained. Displaying these prize categories increases player interest in the player selection game because it shows the player the types of prizes available in the game based on the number of prize modification results which are obtained. Some implementations of the present invention may visually highlight the prize category currently in effect for a player selection. This highlighting may increase player excitement and make it easier for the player to see what prizes are possible for their next selection.

A gaming machine according to one or more embodiments of the present invention includes a display system having at least one display device, a player input system, and at least one processor. One or more memory devices are associated with the processor or processors for storing instructions which are executable by the processor or processors to perform the various operations described above in this section. In particular, the processor or processors execute instructions to cause the display system to anonymously display the player selectable elements, receive the player selection inputs through the player input system, and, responsive to each player selection input, cause the display system to display the selection game result associated with the player selectable element selected by the respective player selection input. The processor or processors also execute instructions to perform the first and any subsequent modifications as described above in this section. The processor or processors also execute instructions to award the prize value associated with each selected player selectable element at the time that player selectable element is selected.

Considering that the present invention may be implemented using one or more general purpose processors, the invention also encompasses program products comprising tangible and non-transitory computer readable data storage devices storing program code. A program product according to the present invention may store program code including selection game program code and award program code. The selection game program code may be executable to cause a display system of a gaming machine to anonymously display the player selectable elements described above in this section, cause the display system to display the selection game results, and perform the first and any subsequent prize value modifications described above in this section. The award program code is executable to award the prize value associated with each player selectable element which is selected, and particularly the prize value in effect at the time that player selectable element is selected.

Some forms of program products according to the present invention may also include prize display program code. This prize display program code is executable to cause the display system to display the prize categories described above in this section, and, in some embodiments, highlight the prize category in effect at a given time in the player selection game.

These and other advantages and features of the invention will be apparent from the following description of illustrative embodiments, considered along with the accompanying drawings.

DESCRIPTION OF ILLUSTRATIVE EMBODIMENTS

In the following description, FIGS. 1-3 will be used to describe example gaming machines and gaming networks through which the present invention may be implemented. Processes which are illustrative of various embodiments of the invention will then be described in connection with the flow chart of FIG. 4. FIGS. 5 through 12 will be used to describe various graphic game displays which may be presented according to embodiments of the present invention.

Figure 1:
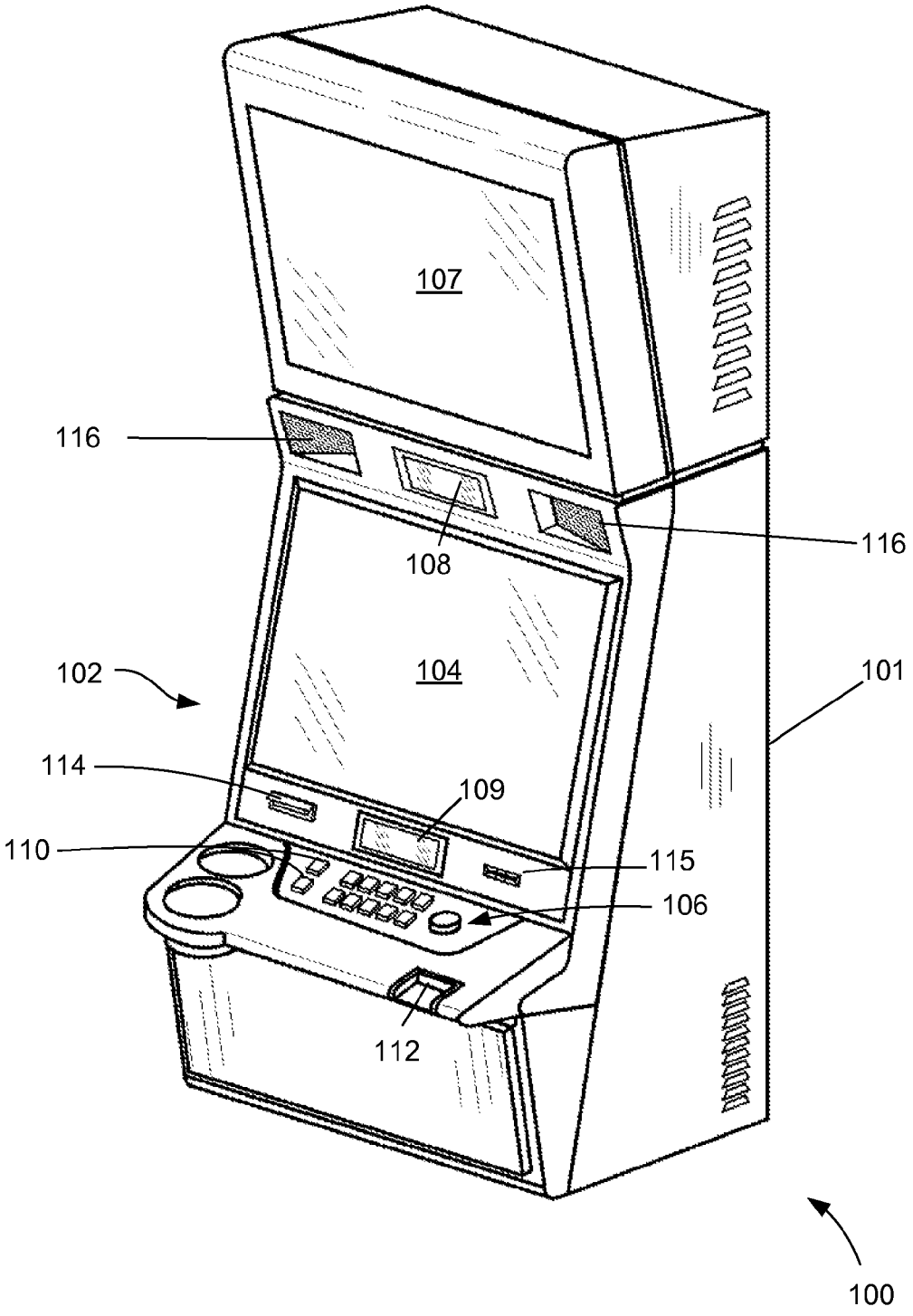
FIG. 1 is a view in perspective of a gaming machine which may be employed in embodiments of the present invention.

FIG. 1 shows a gaming machine 100 that may be used in implementing a wagering game utilizing a player selection game according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics used to implement a player selection game according to the present invention as well as other games implemented through gaming machine 100. For example, a player selection game may be implemented as a second screen bonus game for a reel-type primary game in which results are shown by the manner in which game symbols are aligned along various paylines defined through a symbol location matrix presented by the display device 104. In this example, display device 104 may be adapted to display the primary game, and then transition to display the player selection game in response to some trigger. As will be described further below in connection with FIG. 2 and elsewhere, it is also possible for gaming machines within the scope of the present invention to include mechanical elements such as mechanical reels. In these mechanical reel implementations, the mechanical reels may be used to display results of one game and a player selection game according to an embodiment of the present invention may be presented through any one or more of the video display device associated with the gaming machine. One or more of the video display devices may also be used to show results in the form of a hand of playing cards, a dice roll, a horse race, or in any other fashion in which a result may be displayed. Generally, the display device or display devices of the gaming machine, whether video display devices, mechanical devices, or combinations of the two, which are used to display games according to embodiments of the invention, may be described in this disclosure and the accompanying claims as a display system.

The gaming machine 100 illustrated for purposes of example in FIG. 1 also includes a number of mechanical control buttons 110 mounted on button panel 106. These control buttons 110 may allow a player to select a bet level, select paylines, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls. The player interface devices which receive player inputs in the course of a game played through the gaming machine, such as controls to select a wager amount for a given play, controls to enter a play input to actually start a given play in the wagering game, or controls to allow a player to make player selections in a player selection game according to the present invention, may be referred to generally as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
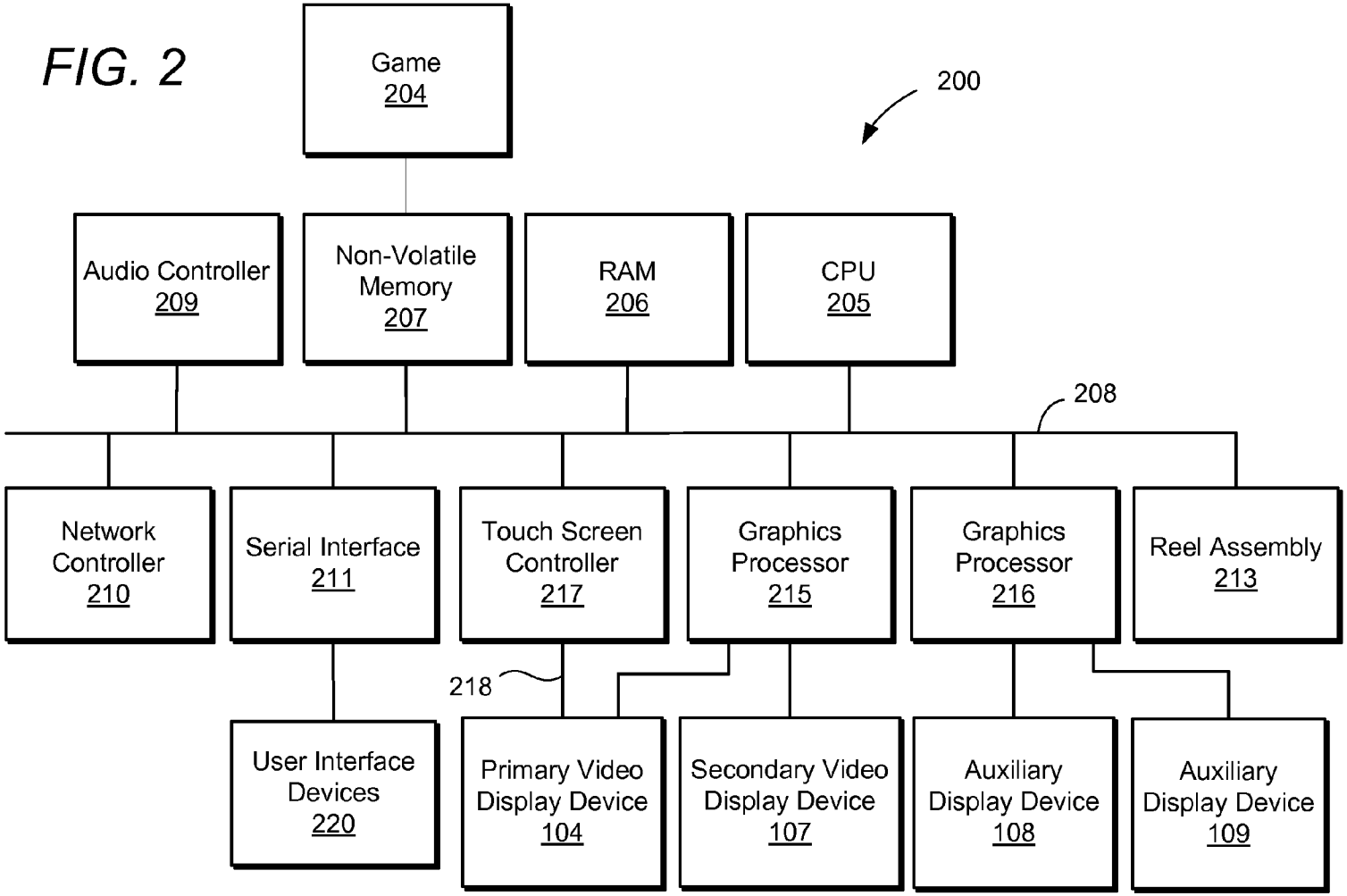
FIG. 2 is a diagrammatic representation of the gaming machine shown in FIG. 1 showing various components of the gaming machine.

FIG. 2 shows a logical and hardware block diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a stand-alone gaming machine and a gaming machine (that is, the part housed in a cabinet such as cabinet 101 in FIG. 1) along with one or more remote components for providing various functions (such as generating outcomes for plays in a game, and driving display devices mounted in a gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include the selection game program code, award program code, primary game program code, and prize display program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the present invention may include mechanical reels. For example, a set of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
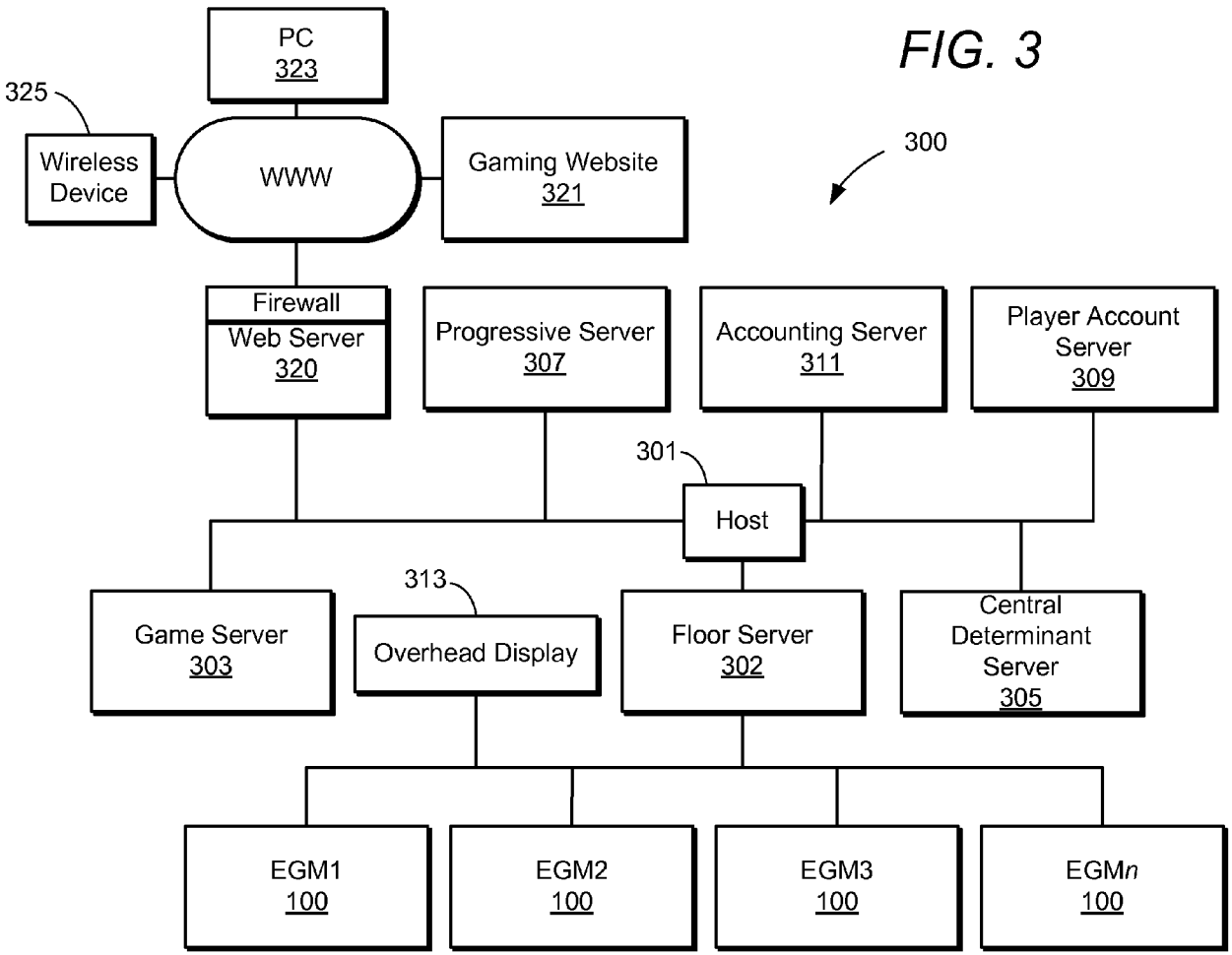
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 (including a player selection game according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the outcome information to networked gaming machines 100 which present the games to players.

Progressive server 307 may maintain progressive pools for progressive games which may be available through the various gaming machines 100. In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and making adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged in to website 321 the player may play various games on the website, including player selection games according to the invention in some cases. Also website 321 may allow the player to make various personalizing selections and save the information so it is available for use during the player's next gaming session at a casino establishment having the gaming machines 100. It will be appreciated that gaming network 300 illustrated in FIG. 3 is provided merely as an example of a gaming network in which wagering games featuring player selection games according to embodiments of the present invention may be implemented, and is not intended to be limiting in any way. The invention is not limited to use in games offered through a gaming network (via the gaming website 321, or via gaming machines such as gaming machines 100, or otherwise). For example, player selection games according to the present invention may be offered through a stand-alone gaming machine having a configuration similar to gaming machine 100 or having any other gaming machine configuration. Also, where games including player selections as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

Figure 4:
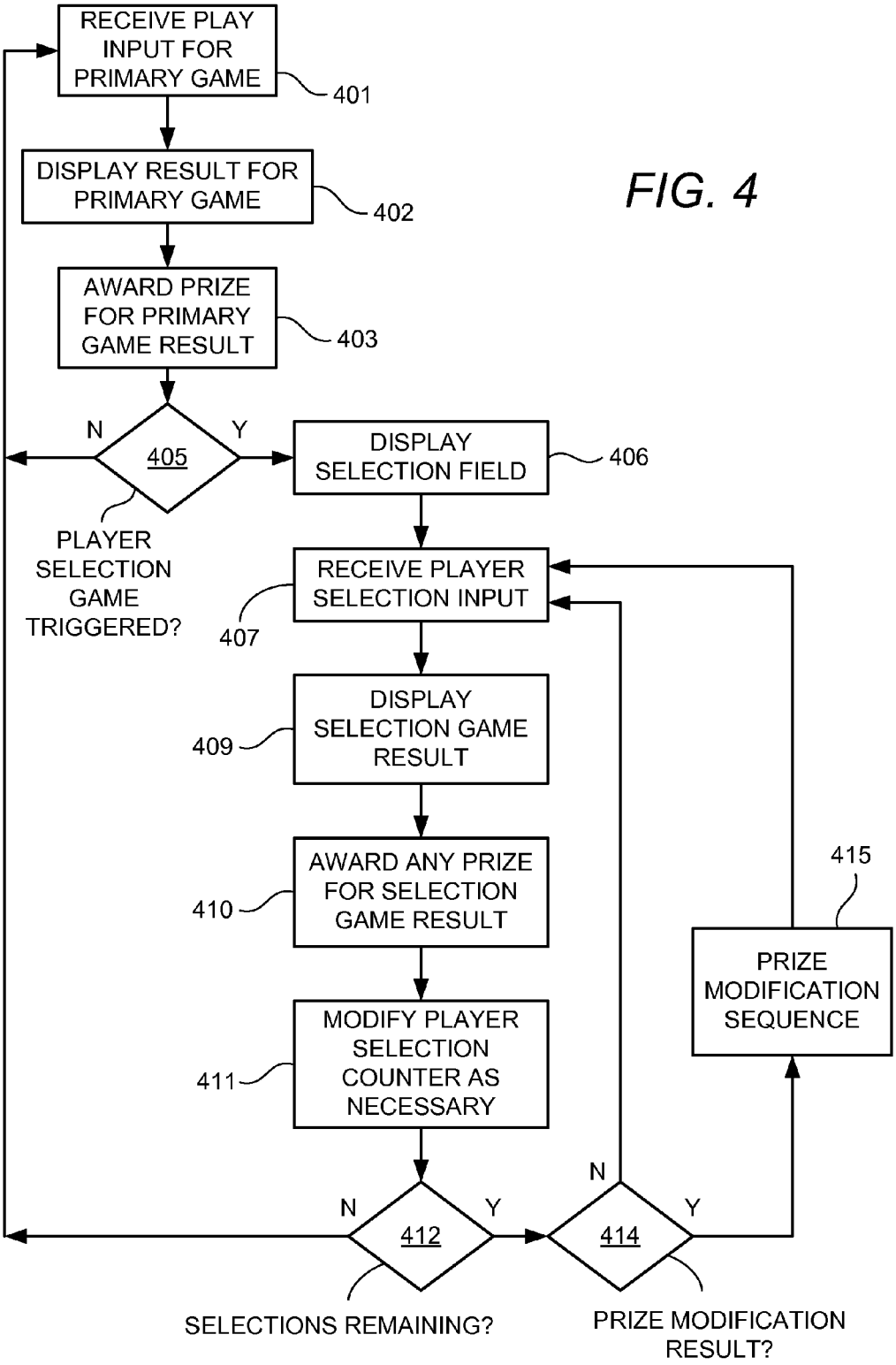
FIG. 4 is a flow diagram illustrating a process flow according to one or more embodiments of the present invention.
Figure 5:
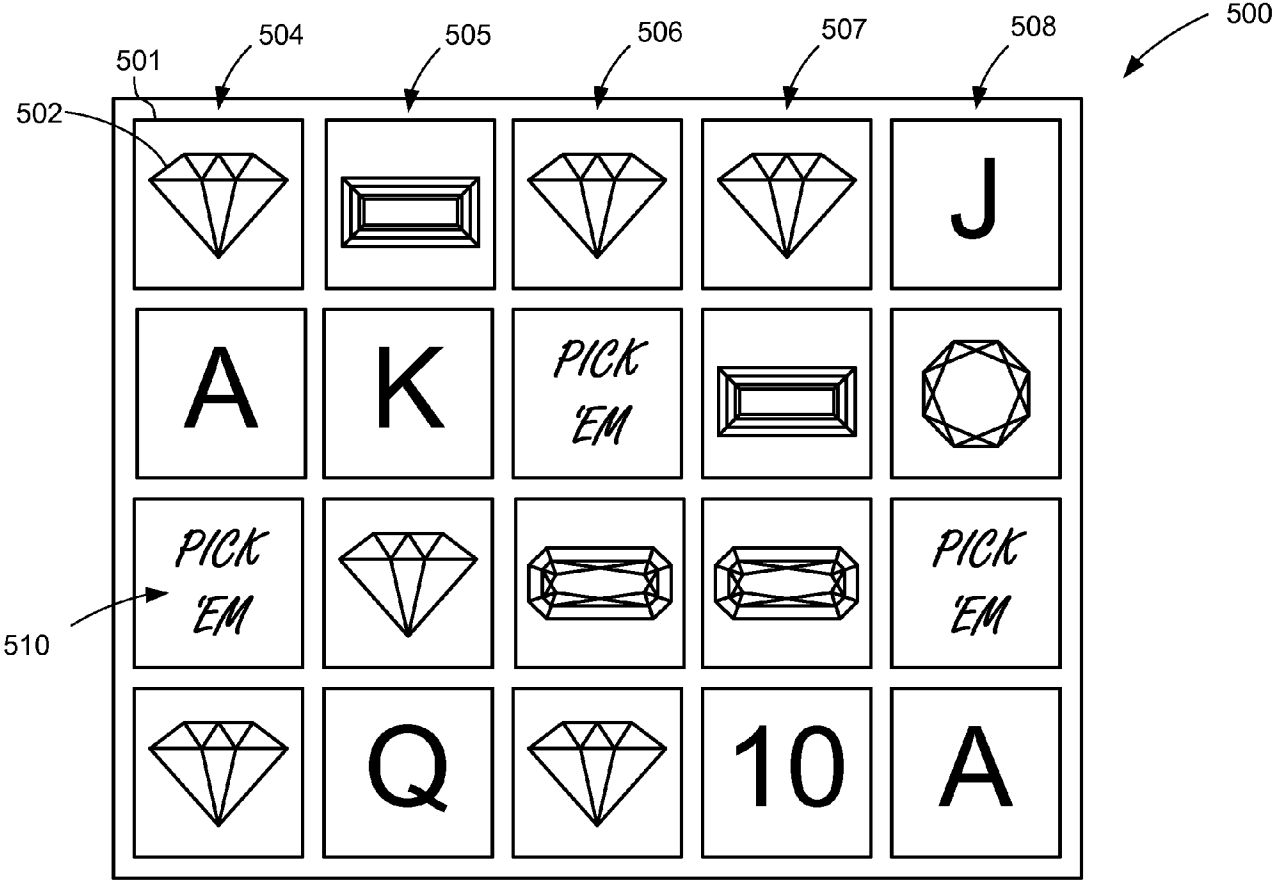
FIG. 5 is a diagrammatic representation of a game presentation showing a trigger for a player selection game according to an embodiment of the present invention.

FIG. 4 is a flowchart showing an example player selection game method according to various implementations of the invention. This example method shows the player selection game as a bonus or secondary game which is entered from a primary game. Thus FIG. 4 includes first receiving a primary game play input at a gaming machine as shown at process block 401, displaying a primary game result at process block 402, and awarding a primary game prize for that result at process block 403. The method then includes determining whether the player selection game is triggered as indicated at decision block 405. If there is no trigger for the player selection game, the process simply returns to receive the next play input for the primary game. However, if the player selection game is triggered, the process branches to conduct the player selection game according to the present invention.

The player selection game sequence illustrated in the example of FIG. 4 includes displaying a selection field including a number of player selectable elements as indicated at process block 406. An example of such a selection field will be described below in connection with FIG. 6. After the selection field is displayed, the illustrated example process includes receiving a player selection input as indicated at process block 407, displaying a selection game result as shown at process block 409, awarding any prize for the displayed selection game result as shown at process block 410, and modifying a player selection counter as necessary as indicated at process block 411. If there are no further player selections available for the player selection game as indicated by a negative outcome at decision box 412, the process returns to receive another input in the primary game. However, if further player selections are available, the process continues to determine, as indicated at decision box 414, whether the result for the player selection input at block 407 is a prize modification result. If not, the process returns to receive another player selection input in the player selection game. For an affirmative outcome at decision box 414, the process continues on to perform a prize modification sequence as indicated at process block 415 prior to returning to receive another player selection input at block 407.

The process steps conducted as shown at 401, 402, 403, and 405 represent one instance of the primary game in the example of FIG. 4. The remainder of the process beginning at process block 406 represents an instance of a player selection game according to the present invention.

It should be noted that the illustrative process shown in FIG. 4 omits any initialization step which is typically required before a gaming machine is in condition to receive a game play input. Methods according to the invention may be employed in gaming systems that utilize any gaming machine initialization process. For example, it may be necessary for a player to log in at a given gaming machine using a player identifier or player card in order to place the gaming machine in condition to receive a game play input to initiate a play in the game. As another example, it may only be necessary for a player to insert cash into the gaming machine or insert a cash-in ticket or otherwise place value on the gaming machine (that is, in memory associated with the gaming machine) to place the gaming machine in condition to receive a game play input to initiate a play in the game. The step or steps associated with initializing the gaming machine at the outset of play in the primary game are omitted from FIG. 4 so as not to obscure the invention in unnecessary detail.

The invention encompasses any arrangement by which a game play input may be received as shown at process block 401. A game play input is commonly received through a player input system associated with the gaming machine, such as one of the player interface devices 220 shown in FIG. 2. For example, a "PLAY" button on button panel 106 in FIG. 1 or a virtual "PLAY" button implemented on a touch screen associated with display device 104 in that Figure may be used to send a game play input which is received by the gaming machine CPU 205 (FIG. 2). In any case, the game play input will be associated with a wager for the respective play at the gaming machine. The wager may be expressed in terms of the credit value, monetary value, or in any other fashion, and may be selected separately from activating a "PLAY" button using wager level controls included on a player control button panel such as panel 106 in FIG. 1, or elsewhere on the gaming machine.

Although not shown in FIG. 4, the primary game may include a separate step of obtaining a game result in some fashion so that the result may be displayed as indicated at process block 402. Obtaining a game result for the game play input may be performed in any number of ways. For example, results may be obtained through a bingo game as in a class II gaming system, or may be obtained by drawing a lottery record as in some class III gaming systems. As another example, a gaming system may employ a centralized or local random result generator and the step of obtaining a result may include issuing a request to that result generator and receiving the generated result. The gaming machine may then interpret the received result as necessary and generate a corresponding display through the display system of the gaming machine. For example, the received result may indicate a certain prize or result in a reel-type game, and the gaming machine may then control mechanical or virtual (video-generated) reels to show the indicated result. In other implementations of a primary game such as that indicated in FIG. 4, the gaming machine may randomly select a number of elements which form the displayed result at process block 402, and then any prize associated with that result is identified from evaluating that display. This latter arrangement for obtaining a result for the game play input would be the case where the underlying game is a reel-type game utilizing independent random reel stops to identify a result for the game play input.

Regardless of how a result is displayed for the primary game as indicated at process block 402, the illustrated primary game process ultimately includes awarding any prize associated with that result. The awarding step shown at process block 403 in FIG. 4 may be accomplished, for example, by increasing a credit meter at the gaming machine by an amount correlated to the prize which has been won. This may be done under the control of a processor (such as processor 205 in FIG. 2) at the gaming machine or a remote processor. Alternatively, the gaming machine may issue currency or some currency equivalent for the prize which has been won, issue some physical object, or some other type of value or benefit. Cash prizes and some other types of physical prizes may be dispensed by a suitable mechanism at the gaming machine, and large value prizes of any type may be awarded via a hand pay process as is known in the art. The invention is not limited to any particular arrangement or method of awarding prizes at process block 403 in FIG. 4.

It should also be noted that the step of awarding a prize as shown at process block 403 in FIG. 4 need not be performed immediately after displaying the result and before any of the other steps shown in the process as indicated by the figure. Rather, any prizes for a winning result for the play input may be awarded at any suitable point in the process such as part of an end play sequence prior to returning to receive the next play input at process block 401. More generally, many of the steps indicated for the primary game or player selection game shown in FIG. 4 may be performed in some other order without departing from the scope of the present invention.

The determination indicated at decision box 405 may be made in any suitable manner in the example process shown in FIG. 4. In one embodiment, the result displayed for the primary game as indicated at process block 402 may comprise a result that represents a trigger for the player selection game according to the present invention. For example, certain special symbols appearing in a reel-type game result display may represent a triggering event for the player selection game. In this case the determination indicated at process block 405 may be made by evaluating the result displayed for the primary game. Alternatively, where the result displayed at process block 402 is dictated by a lottery result, bingo result, a result generated at a gaming machine result generator or generated at a remote result generator, or in any other fashion which dictates the result which is displayed for the primary game, the determination indicated at decision box 405 may be controlled by the dictated result. For example, a remotely generated result may comprise an index value which dictates that the result to be displayed at the gaming machine at process block 402 is a non-winning result in the primary game, but is a result defined as triggering the player selection game. In other implementations the dictating result may be a winning result associated with some prize to be awarded, plus a result defined as triggering the player selection game. In any process which generates or obtains an outcome in the primary game, and then displays a result consistent with that outcome, the process at decision box 405 may include evaluating that generated outcome to determine if it is defined as a trigger for the player selection game.

Although the example of FIG. 4 shows the player selection game commencing only after a play in a primary game, the present invention is not limited to this arrangement. Rather, a player selection game embodying the principles of the present invention may be implemented as a primary game or a stand-alone game in which a player enters a wager to play similarly to the step shown at process block 401 in FIG. 4. In yet other implementations, a player selection game may be a tertiary or later game rather than a secondary game as shown in FIG. 4. A player selection game according to the invention is not limited to any particular level or relationship with any other game, and is not limited by any particular manner of entry.

Displaying the player selection field as indicated at process block 406 to display a number of player selectable elements for the player selection game may be accomplished in a number of different ways. The player selectable elements are displayed anonymously, that is, in a way in which it is not apparent to the player what selection game result is associated with a particular player selectable element. The player selectable elements may be displayed in any graphic form, such as some graphic element or feature which appears to hide a result. Different graphic elements may be used in a given player selection field, or each player selectable element may be displayed with a respective instance of a single graphic element. Any suitable number of player selectable elements may be displayed in the initial player selection field at process block 406. The number of player selectable elements shown in the selection field may change over the course of the player selection game or the number of such elements may stay static over the course of the game. Also, the character of the various player selection elements may change over the course of the player selection game. Such an arrangement will be described below in connection with the example shown in FIGS. 5 through 12.

Each of the displayed player selectable elements is ultimately associated with a respective selection game result representing a result in the player selection game. The selection game result for a given player selectable element may be a prize such as some credit value, or no prize. At the time the initial selection field is displayed as indicated at process block 406, the prizes associated with or available for association with the displayed player selectable elements may be within a first set of prize values, 100, 250, 500, 750, and 1000 credits, for example. At least one of the selection game results associated with or available for association with a given player selectable element comprises a prize modification result. When a player selects a player selectable element associated with the prize modification result, the process includes performing the prize modification sequence as will be described below in connection with process block 415. As will also be described further below, each prize modification result may also be associated with a player selection increasing value which has the effect of increasing the number of player selections remaining for the instance of the player selection game. Prize modification results may also be associated with some prize value.

Each player selectable element may be associated with one of the selection game results in any suitable fashion. For example, one implementation of the invention may assign various selection game results to be various player selectable elements and that assignment or mapping may remain intact (static) for the remainder of the game or until a prize modification is performed according to the invention. Alternatively, selection game results may be associated with the various player selectable elements dynamically over the course of the player selection game. In one dynamic association arrangement, the result for a primary game or the result obtained for the play of the player selection game may dictate an overall result of the player selection game. In this case, the player selection game is controlled to produce the dictated result regardless of the player selections. For example, at the outset of the player selection game, the gaming machine processor or some other processor may produce a script which defines the result for each player selection to produce the desired overall result. One possible script may dictate that the first player selection shows a result of no value while a second player selection shows a result of 500 credits and a third selection shows a result of 500 credits. Such a script might be produced for a desired overall outcome of 1000 credit win for an instance of the player selection game. Such a script may also conduct a prize modification according to the invention and include prizes which have been made available through a prize modification as will be described further below. In the case of such scripted play in the player selection game, the player selectable elements are not statically associated with any given selection game result. Rather the association is made at the time the player makes the selection.

In other alternatives within the scope of the invention, the association between a particular player selectable element and a selection game result may be made on the fly as the player makes their various selections. For example, for each player selection, the process may include making a random selection from a set of selection game results in effect at that time to randomly associate a selection game result with the player selectable element which has been selected. The set of selection game results may include the prize modification result, a 0 value result, and a suitable group of prize values in effect at that point in the player selection game.

The player selection input indicated at process block 407 may be any suitable input by the player, or perhaps for the player, to select one of the player selectable elements. In one preferred arrangement the player selectable elements displayed according to process block 406 are displayed on a touch screen display device and the player makes their player selection input by touching the location of the desired player selectable element. That touch produces the input which is received as indicated at process block 407 in FIG. 4. In other arrangements some pointer may appear on the screen and the player may use some sort of pointer control to control the position of pointer over a desired player selectable element and then operate some other control to make the selection of that particular player selectable element. In yet another arrangements within the scope of the present invention, a pointer may randomly move around the selection field containing the various player selectable elements and the player may activate some control at a point in time at which the pointer is located over the element the player desires to select.

The selection game result may be displayed as indicated at process block 409 by replacing the selected player selectable element with some indication of the result. Any graphic technique may be used to change from the player selectable element to the indication of the selection game result. For example, a player selectable element may include a door and the door may open to reveal the associate selection game result when that element is selected. In another example player selectable elements may comprise balloons which pop when selected to reveal the associated selection game result. In some forms of the invention the player selectable element may simply disappear and the selection game result to be displayed may simply appear in the place of that player selectable element.

A prize to be awarded for a given displayed selection game result may be awarded in any suitable manner similar to the process shown at process block 403 for the primary game results. In some forms of the invention prizes are awarded by incrementing one or more credit meters by the amount of the prize value. The award may be made for every selection as indicated in the process shown in FIG. 4, or the awarding step may be deferred until all player selections have been made, and then all prizes may be awarded sequentially or in any other suitable fashion.

A player selection game according to the present invention will be associated with a number of player selections that are available for the game. For example, a player may be allowed three selections from the various available player selectable elements for each instance of a player selection game according to the present invention. Alternatively, the number of selections may vary from one instance of the player selection game to the next. It is also possible for the overall number of player selections to vary over the course of an instance of the player selection game. An example of such an arrangement includes a player selection game in which the various selection game results defined for the game increase, or perhaps decrease the number of player selections available for an instance of the player selection game. In one form of the invention, each prize modification result also includes an increase in the number of player selections by at least one. This arrangement prevents the situation in which a player's last selection reveals a prize modification. In this case the prize modification result is of no benefit to the player because they have no more selections left to take advantage of the higher prizes available after a prize modification according to the invention. In some implementations, the number of player selections for a given instance of the player selection game may be dictated by the trigger which triggered the player selection game. For example, one trigger defined for the player selection game may provide the player with five player selections while another trigger may provide three player selections. The number of player selections available to the player for a given instance of the player selection game may also be randomly determined or determined any other manner at the start of the player selection game, before the start of that game, or even after the start of the player selection game.

Regardless of how the number of selections are determined, the method may include setting a counter to track the number of player selections remaining for a given instance of the player selection game. For example, the number of player selections available for that instance of the game may be displayed concurrently with displaying the selection field as indicated at process block 406. Then the counter may be adjusted after each selection as shown at process block 411. Where the selection game result displayed according to process block 409 does not include any modification of the number of player selections available for that instance of the player selection game, the step at process block 411 will simply decrement the count of remaining player selections by one. However, where the selection game result displayed at process block 409 includes a change to the number of selections remaining, that change may be taken into account in the modification indicated at process block 411.

It should be noted that it is possible to implement the present invention so that the player selections remaining for an instance of the player selection game may be modified without displaying a count modifier as part of the selection game result at process block 409. For example, some implementations of a player selection game according to the present invention may include apparently or truly random increases or decreases to the number of player selections available for that instance of the player selection game. Such increases or decreases in the number of player selections may be communicated to the player in any suitable fashion and not necessarily through displaying the selection game result at process block 409.

Determining if there are any player selections remaining at decision box 412 may comprise simply evaluating the value of the counter maintained according to process block 411. For example the determination at decision box 412 may include determining if the counter value is not equal to zero. If the counter value is not equal to zero, the outcome at decision box 412 is affirmative and the process continues to decision box 414. However, if the counter value is equal to zero then the outcome at decision box 412 is negative and the process returns to the next instance of the primary game beginning at process block 401. Any suitable method may be employed to provide the evaluation to determine if there are selections remaining at decision box 412.

The determination at decision box 414 may also be accomplishing any suitable fashion. For example, in the event the selection game result displayed at process block 409 comprises a prize modification result, the system may set a register to a certain value. Determining whether the current result is the prize modification result may then involve simply evaluating the register value. If register value is equal to the set value then the outcome at decision box 414 is affirmative and process proceeds to the prize modification sequence at process block 415. Otherwise if the evaluation indicates that the register value is not equal to the predefined value set for a prize modification result, then the process proceeds to receive another player selection input at process block 407. In other implementations, each selection game result displayed as shown at process block 409 may be associated with an index value. In this case, the determination at decision box 414 may be made by evaluating the index value associated with the displayed selection game result, and an affirmative result is produced when the index value is recognized as a value associated with a prize modification result.

The prize modifying sequence at process block 415 in FIG. 4 modifies the prize associated with each player selectable element which has not yet been selected in that instance of the player selection game. In preferred forms of the invention, the prize modification increases each prize so that each prize (that is, each winning prize) is greater than the highest prize included in the first prize set. The manner in which the modification is performed will depend in part on how the selection game results are associated with the various player selectable elements. Where each player selectable element which has not yet been selected in the player selection game is statically associated with a respective selection game result at the outset of the player selection game, the modification includes modifying at least each of those associated winning results so that the lowest prize available after the modification is higher than the highest prize available prior to the modification. The invention may or may not include changing any statically associated losing results (a result having no prize) to a winning result. Where selection game results are associated with player selectable elements dynamically in some fashion, the modification includes modifying the set of prize values available for selection game results so that the modified prize values are assigned to the player selectable elements in the particular dynamic fashion.

In some implementations of a player selection game according to the present invention, a number of different winning prize sets are defined for the game, each respective prize set including a number of different levels of prize values. One of the prize sets may be defined as a the first prize set having prizes available for player selections from the initial selection field displayed as indicated at process block 406 in FIG. 4. Another prize set may be defined as a second prize set containing prizes available after a first modification according to the present invention. A third prize set may contain prizes available after the second prize modification, and so forth for as many prize modifications are possible in the course of the given implementation of the player selection game. Such an arrangement will be illustrated below in connection with FIGS. 11 and 12. In these implementations, the prize at one level in one prize set may be correlated to the prize at the corresponding level in another prize set. The prize modifications in these implementations may include modifying the prize at each level in the current set to the prize at the corresponding level of the next prize set. However, it should be appreciated that player selection games according to the present invention are not limited to modifying prizes in this fashion. For example, the lowest prize value in the first set of prize values may be modified in a modification according to the present invention to the highest or any other prize available in the second set of prize values.

In addition to the prize modification at process block 415, the invention may include modifying a graphic effect presented by the gaming machine to inform the player of the prize modification. For example, the player selectable elements may change graphically as the prizes associated with the player selectable elements, or to be associated with the player selectable elements, are modified. The change in appearance of the player selectable elements indicates to the player that an increased prize may be awarded with the next player selection thereby increasing player excitement and interest in the game. Messages that all prizes have been increased may also be displayed as part of the prize modification sequence indicated a process block 415. Also, the various prize sets may be displayed concurrently with the player selection game and the prize sets themselves may be modified to indicate which prize set is available for the next player selection.

In some embodiments of the process shown in FIG. 4 each instance of the player selection game may reset the prizes available for the initial selection field (displayed at process block 406) to the same initial or first set of prize values. However, the invention is not limited to this arrangement. Other implementations may include some level of persistence between the various instances of the player selection game. For example, the final set of prize values achieved in one instance of the player selection game may carry over to form the first set of prize values used for the next instance of the player selection game. Such a persistence in the sets of prize values between instances of the player selection game would encourage continued play of the primary game in the hope of reaching sets of higher prize values for further instances of the player selection game.

The diagrammatic representations of game displays shown in FIGS. 5-12 show a specific example of a player selection game implementation according to the present invention. The example starts with a reel-type game presentation 500 shown in FIG. 5. This game presentation may be for a primary game such as the primary game indicated in the process shown in FIG. 4, and may display the primary game result indicated at process block 402 in FIG. 4. This example reel-type game presentation 500 includes five reels 504, 505, 506, 507, and 508, each showing four vertically aligned symbol locations 501, with each symbol location containing a respective game symbol 502 defined for the reel-type game. In this example, the trigger for a player selection game according to the present invention includes three "PICK 'EM" symbols 510 scattered across the various symbol locations defined by the reels. This reel-type game display result causes an affirmative outcome at decision block 405 (FIG. 4) in this example, and causes the process to move to the sequence for the player selection game.

Figure 6:
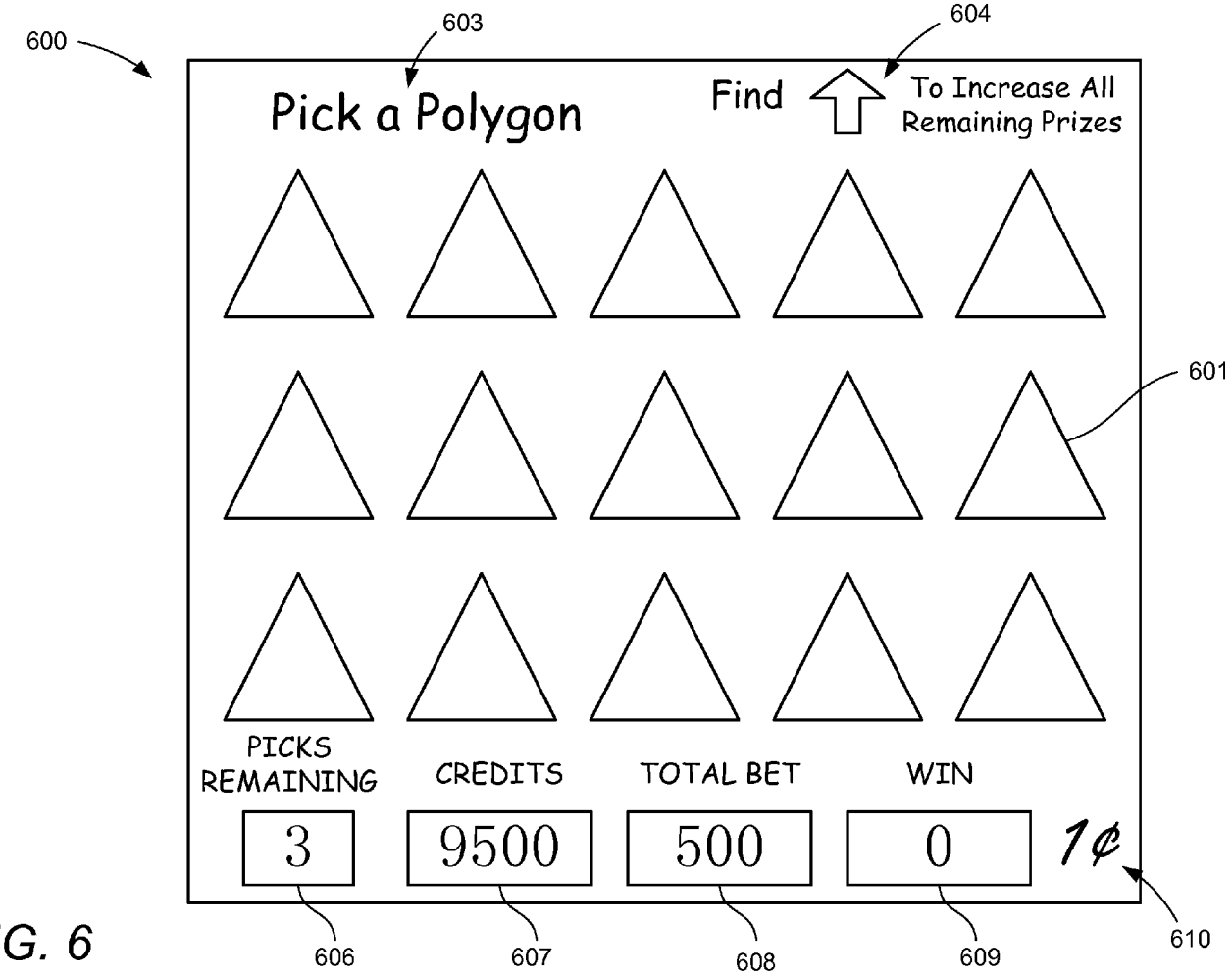
FIG. 6 is a diagrammatic representation showing the initial appearance of a player selection game according to one form of the present invention.

FIG. 6 is a diagrammatic representation of an example player selection field in display 600 presented in accordance with the step at process block 406 (FIG. 4). In this example, display 600 includes a player selection field having a total of fifteen player selectable elements shown as triangles 601. FIG. 6 also shows instructions associated with the player selection game including the instruction "Pick a Polygon" 603 and information 604 regarding an arrow symbol which prompts an increase in all remaining prizes according to the present invention. Display 600 also includes a selections remaining counter 606 labeled "Picks Remaining," a "Credits" meter 607, a current "Total Bet" indicator 608, and a "Win" meter 609 showing the total win for the current instance of the player selection game. A denomination label 610 is also included in display 600 to indicate the denomination for the credits in the game. The example display 600 may be shown on a video monitor, preferably a touchscreen to allow the player to easily select the desired player selectable elements (triangles 601) in the course of the game. It is also possible to provide a mechanical device to provide a display such as display 600. The present invention includes any arrangement for making the displays shown in FIGS. 6 through 10 including both video generated displays and mechanical displays or combinations of the two.

Each of the player selectable elements in FIG. 6, the triangles 601, is associated with either a prize value selected from a first set of prize values or a prize modification result. An example of a first set of prize values will be described below in connection with FIGS. 11 and 12. It is also possible that one or more of the player selectable triangle symbols 601 may be associated with a loss result, that is, no prize value. Regardless of the particular player selection game result associated with a respective one of the player selectable triangle symbols 601, the association may be made in any suitable fashion as discussed above in connection with FIG. 4.

Figure 7:
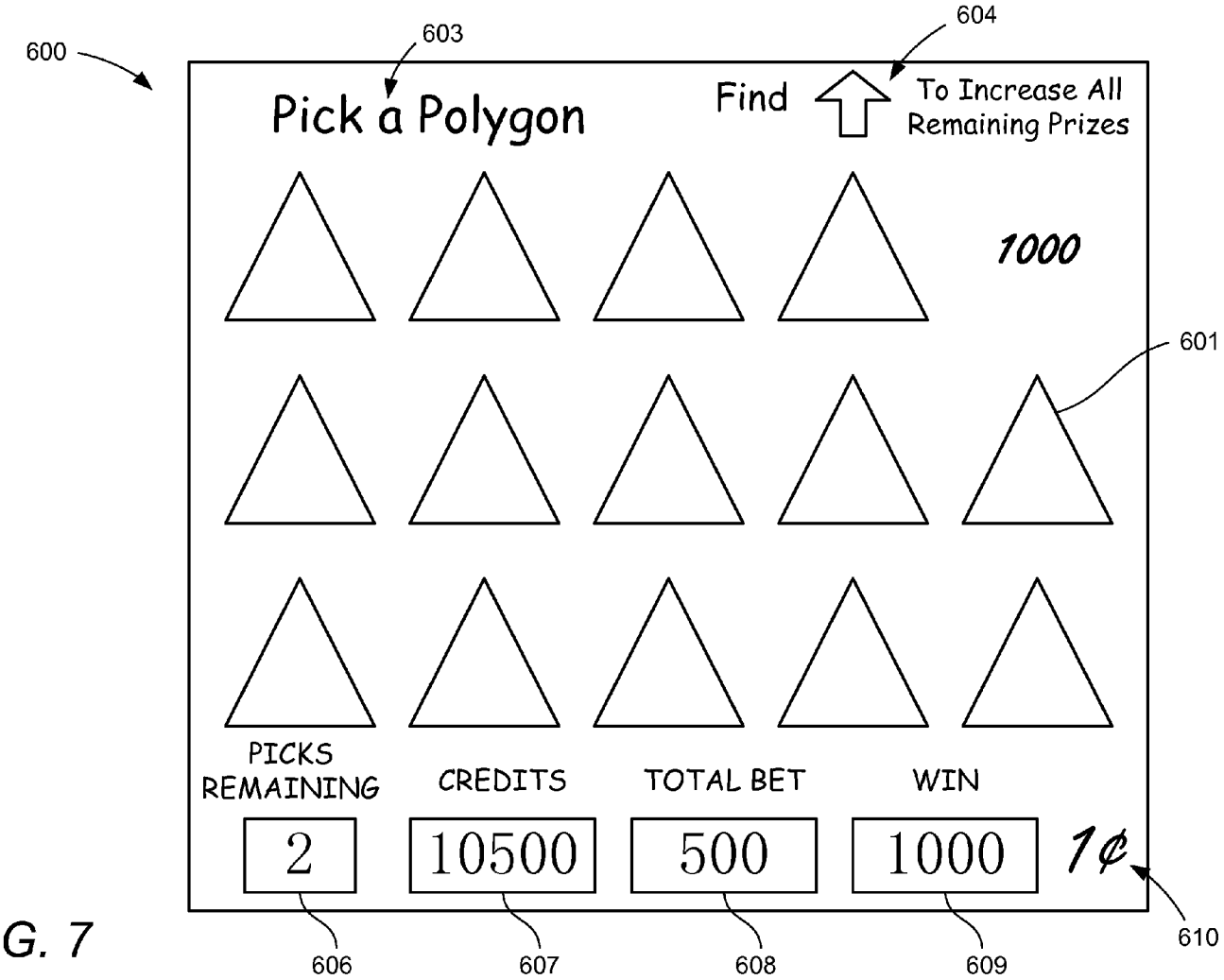
FIG. 7 is a diagrammatic representation of the player selection game shown in FIG. 6 as modified responsive to a player selection of a player selectable element associated with a prize value.

FIG. 7 shows graphic display 600 after a player has selected one of the player selectable elements 601 and particularly the player selectable element in the far right top corner of the field of player selectable elements. In this example, the triangle symbol 601 (selected player selectable element) shown previously at that location is replaced with the prize value associated with that selected element, 1000 credits. The "Win" meter 609 is shown increased by the 1000 credit win value. Also the "Credits" meter 607 is increased by the 1000 credit value. Player selection counter 606 is decremented to show that two player selections remain for this instance of the player selection game.

Figure 8:
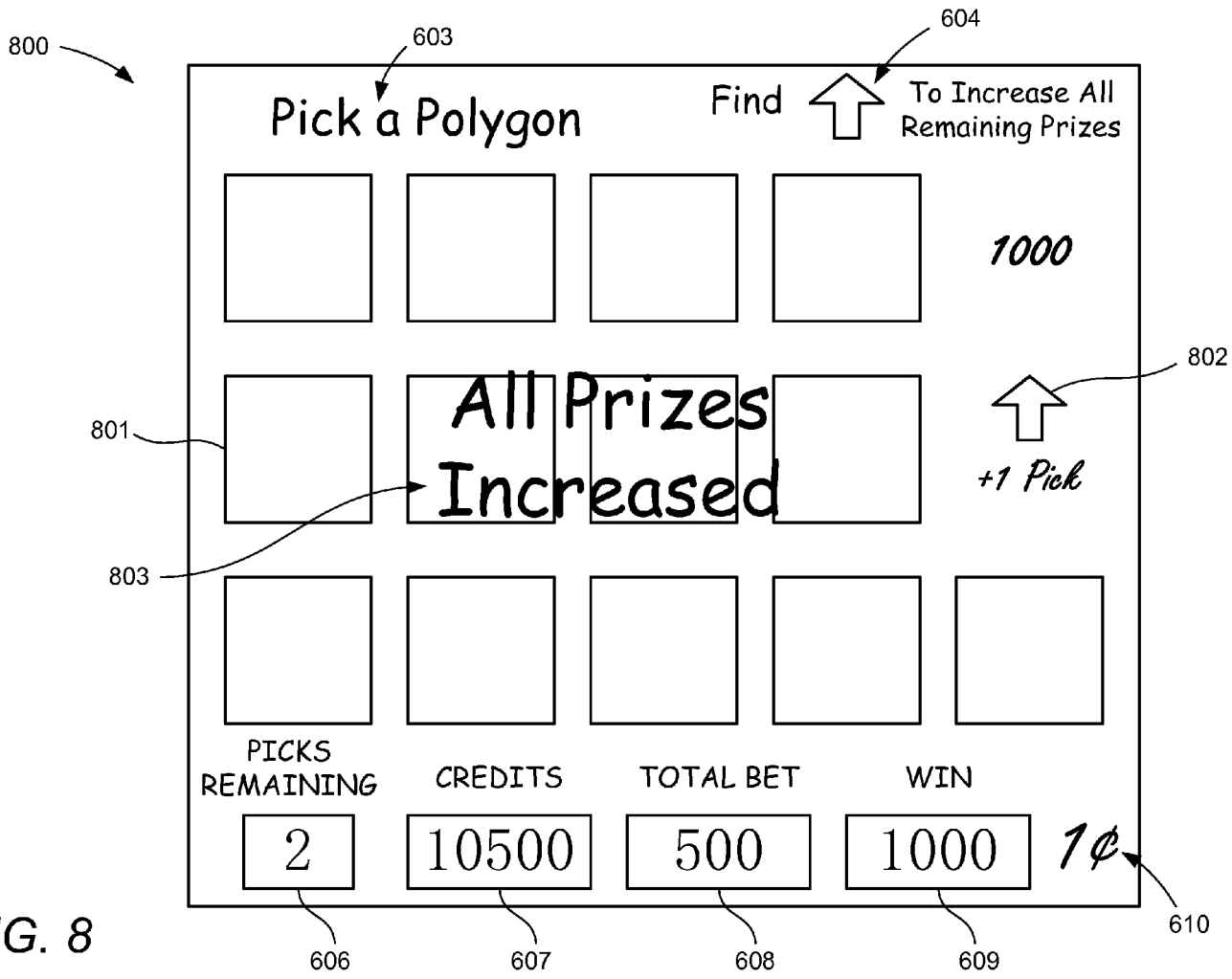
FIG. 8 is a diagrammatic representation of the player selection game shown in FIG. 7 as modified responsive to a player selection of a player selectable element associated with a prize modification result.

FIG. 8 shows a display 800 which is produced in response to a player selection of a player selectable element associated with the up arrow 802 corresponding to a prize modification result for that selection. The prize modification result indicated by arrow 802 is also associated with a "+1 Pick" label indicating that the number of player selections remaining is increased by one by virtue of having selected the player selectable element previously shown at that location. In this example, all the player selectable elements are modified from the triangle symbol 601 to player selectable elements 801 comprising square symbols. This change in the player selectable elements indicates to the player that the prizes which may be associated with the various player selectable elements have been modified. Informational message 803 is also displayed in the example of FIG. 8 to inform the player that all prizes have been increased (that is, all prizes potentially available for the next player selection have been increased). This informational message 803 is preferably displayed only temporarily, perhaps as part of the graphic transition from the initial triangle symbols to the square symbols for the player selectable elements in this example. Player selection counter 606 remains unchanged in view of the additional selection associated with the prize modification result.

Figure 9:
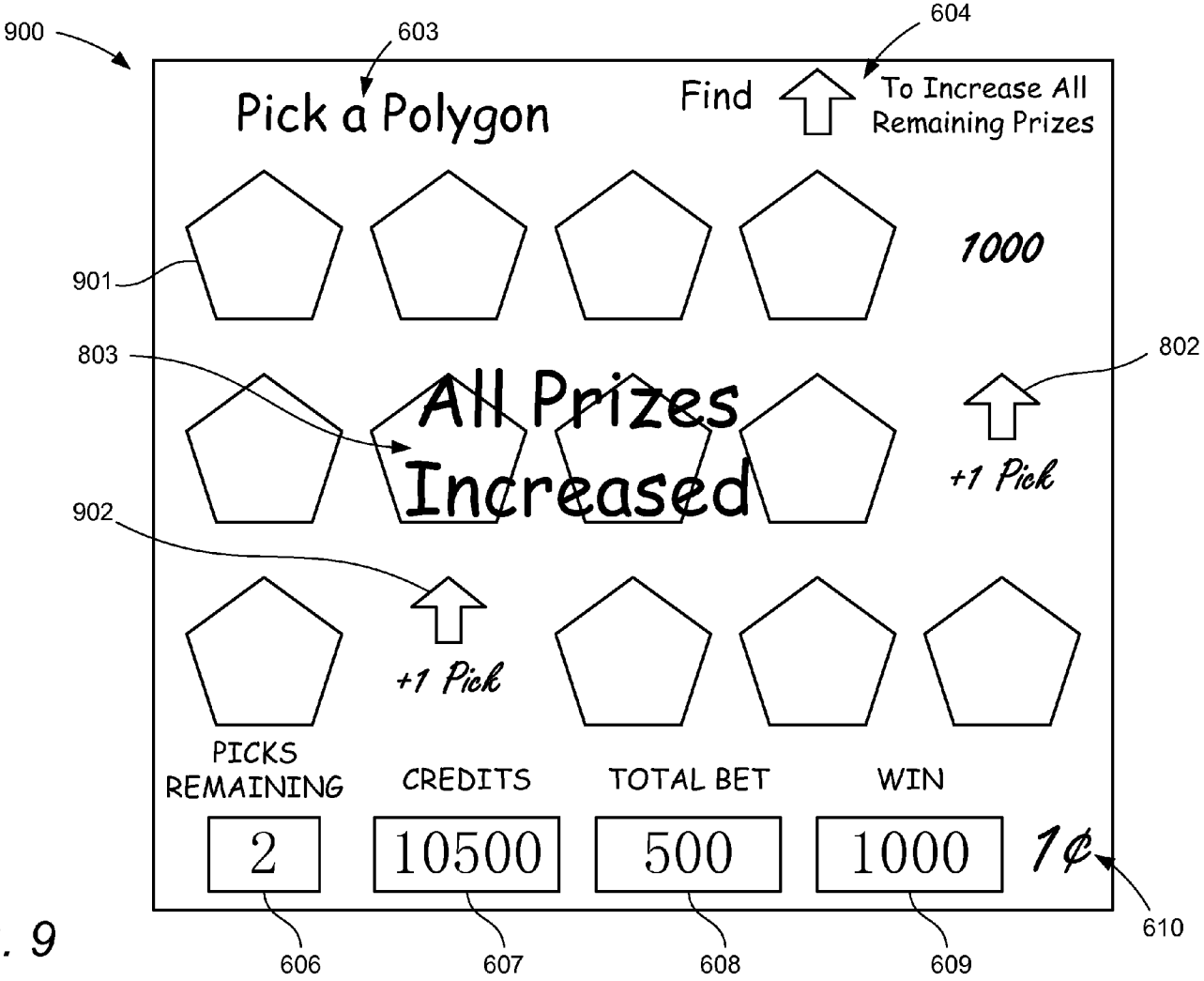
FIG. 9 is a diagrammatic representation of the player selection game shown in FIG. 8 as modified responsive to a second player selection of a player selectable element associated with a prize modification result.

FIG. 9 shows an example display 900 after the next player selection selects another player selectable element associated with a prize modification result as indicated by arrow symbol 902 and the "+1 Pick" label. Because the result associated with the player selection is the prize modification result defined for the game, the prizes which may be associated with the various player selectable elements are all increased a second time. In this example all the player selectable elements are changed to show player selectable elements 901 comprising pentagon symbols to indicate to the player that the potential prizes have been increased. Also informational message 803 is displayed again to indicate to the player that the prizes available for further selections have been increased. In FIG. 8, player selection counter 606 remains unchanged in view of the additional selection associated with the prize modification result.

Figure 10:
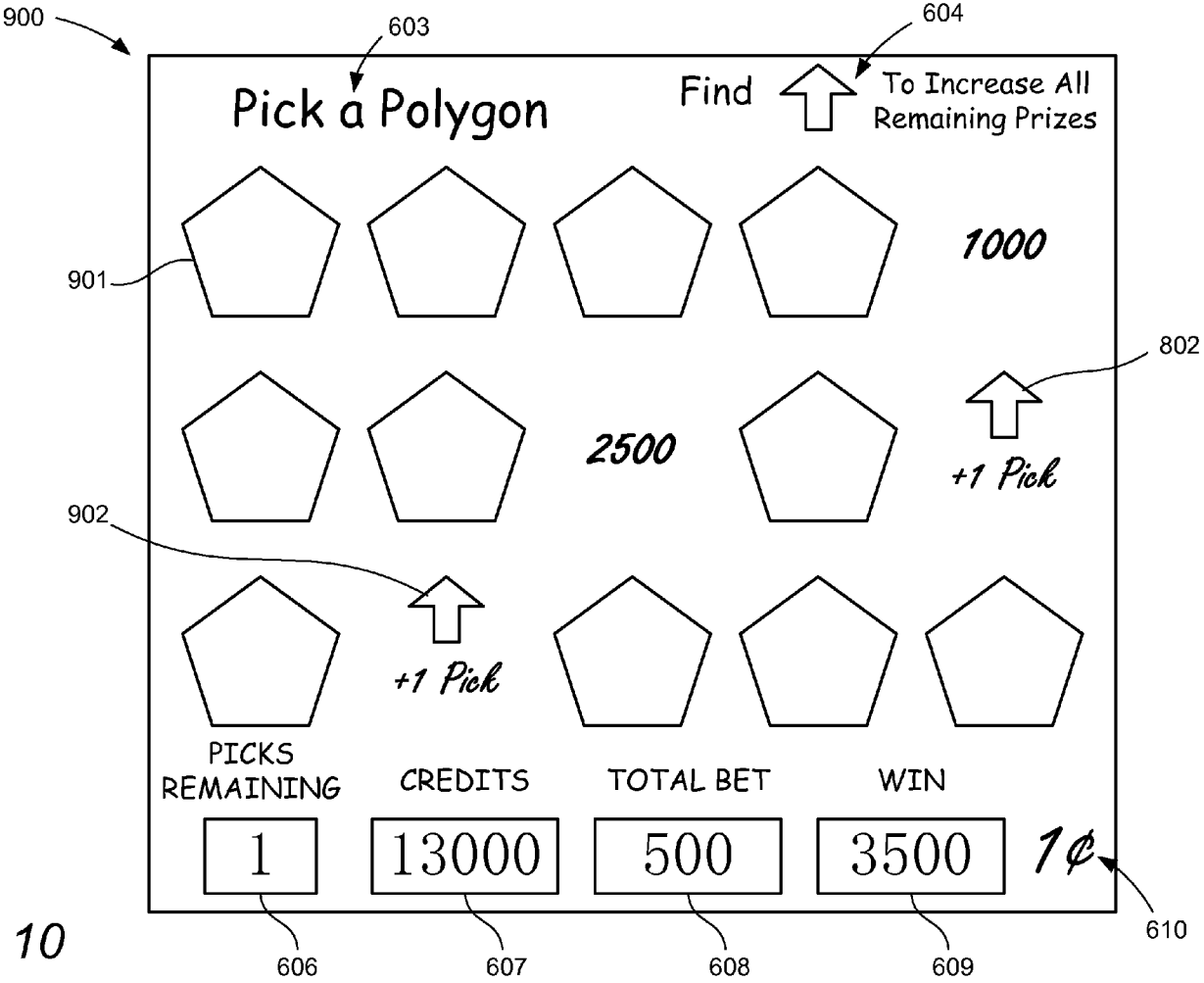
FIG. 10 is a diagrammatic representation of the player selection game shown in FIG. 9 as modified responsive to a player selection of a player selectable element associated with another prize value.

FIG. 10 shows the display 900 after the player has made another selection. In this case the player has selected the player selectable element at the center of the display and this player selectable element has disappeared to display a prize value of 2500 credits as the selection game result associated with that selected element. This prize value increments the "Win" meter 609 and the "Credits" meter 607 by the 2500 credit amount. Selection counter 606 is decremented by the player's selection, and now shows one remaining player selection for this instance of the player selection game.

It should be noted that the example player selection game illustrated in FIGS. 6-10 assumes that there is a single prize modification result represented by an up arrow symbol. However, other forms of the invention may include different possible prize modification results, each represented by a different symbol in the game graphics. The different prize modification results may be associated with different prize values and/or different prize modifiers. The particular prize modification result associated with a given player selectable element may be selected from a set of different prize modification results.

Figure 11:
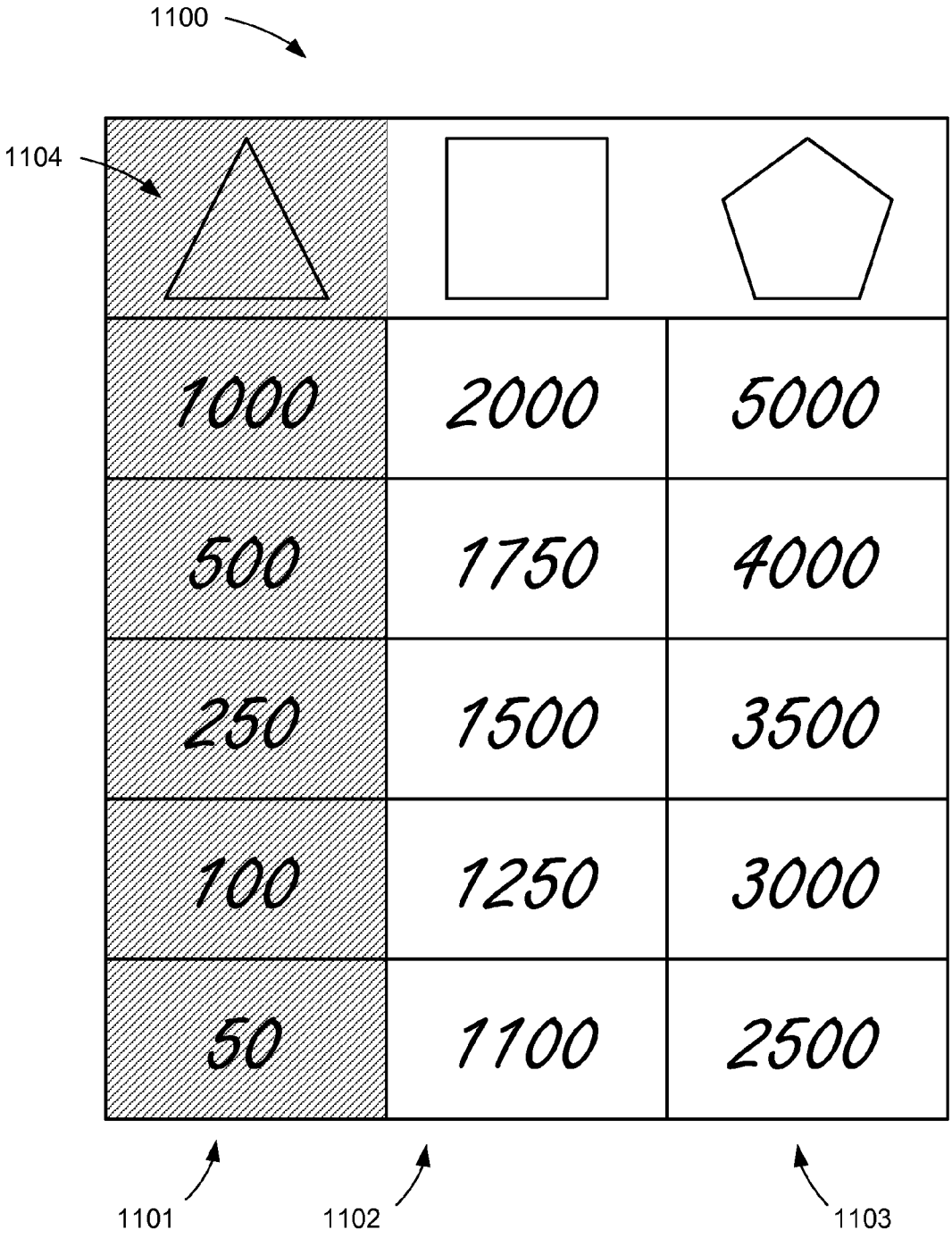
FIG. 11 is a diagrammatic representation of a series of prize schedules which may be employed with the player selection game illustrated in FIGS. 6-7.
Figure 12:
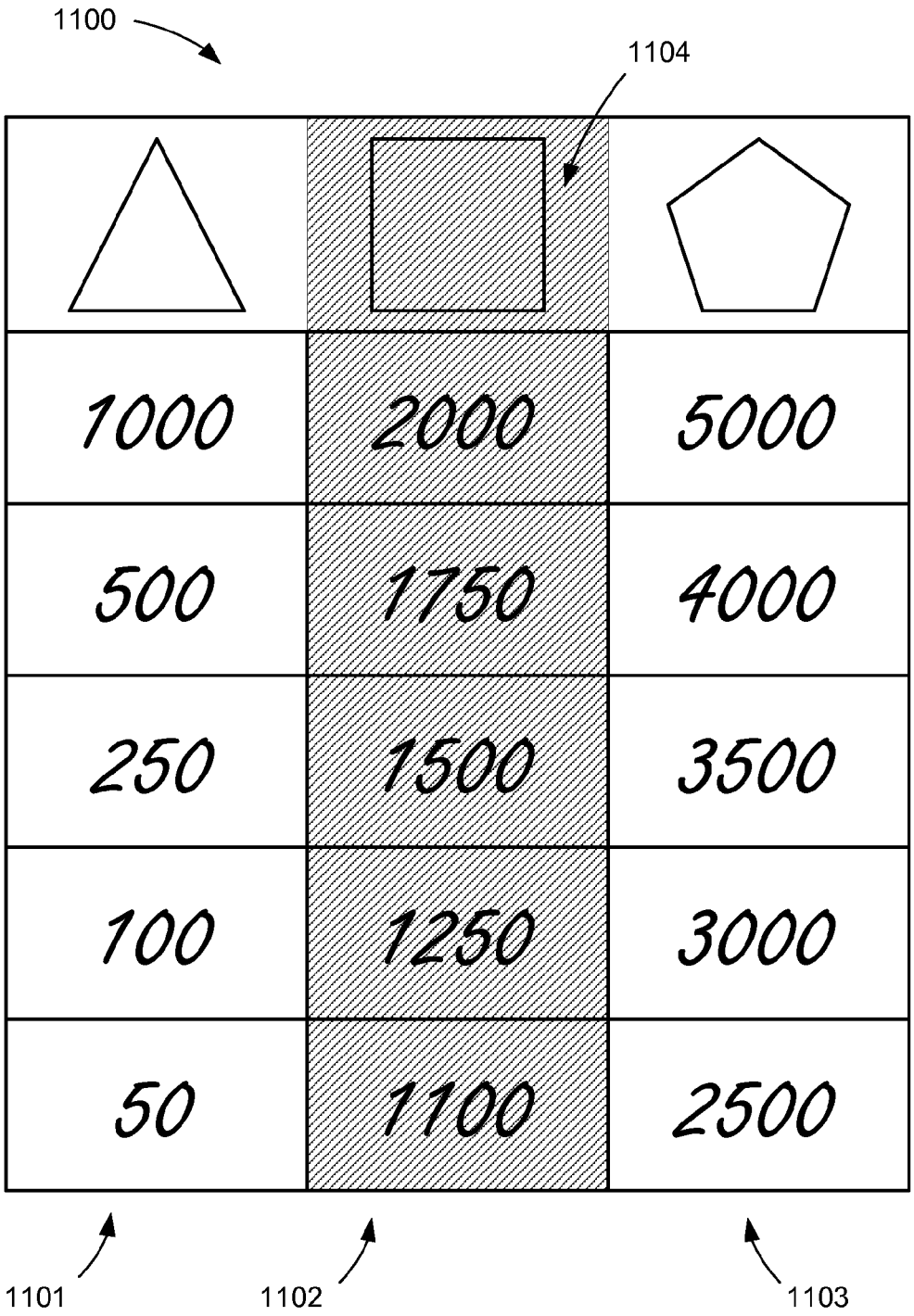
FIG. 12 is a diagrammatic representation of the series of prize schedules shown in FIG. 11 as modified responsive to the player selection indicated in FIG. 8.

FIGS. 11 and 12 show three prize sets that may be used for the example game indicated in FIGS. 6 through 10. These prize sets show only the winning results and thus include no zero result prize level. Prize set 1101 includes a list of prize values aligned under the triangle symbol showing that the prizes in that prize set are in effect when the triangle symbol is shown for the player selectable elements in the player selection field. The triangle symbol in this example implementation provides an indication to the player of the number of prize modification results which have been obtained for that instance of the game to place that prize category in effect for a player selection. Namely, the triangle symbol indicates that no prize modification results have been obtained yet for that instance of the player selection game. Prize set 1102 includes a list of prize values aligned under the square symbol while prize set 1103 includes a list of prize values aligned under the pentagon symbol. Again, each of the symbols serving as the heading for the respective prize set provide an indication of the number of prize modification results which must be obtained in the instance of the player selection game to activate that prize category for a given player selection. The square symbol indicates that one prize modification result has been obtained in an instance of the player selection game and the pentagon symbol indicates that two prize modification results have been obtained for the instance of the player selection game. FIG. 11 shows the state of the prize set display that may be displayed to the player for the initial player selection field display shown in FIGS. 6 and 7. In this example, prize set 1101 and the corresponding triangle symbol are highlighted represented by hashing 1104 to indicate that this particular category or set of prizes is in effect at that time. In FIG. 12, the highlighting represented by hashing 1104 is moved to prize set 1102 and the corresponding square symbol. FIG. 12 represents the state of the prize set display that would be shown to the player for the player selection from display 800 shown in FIG. 8 after the informational message 803 is removed. Keying the prize set display to the player selectable symbols readily communicates to the player that the illustrated prizes are available for player selections made while the given symbols are displayed. Of course the invention is not limited to any particular number of prize sets that may be displayed in an arrangement such as the example of FIGS. 11 and 12. However, it is possible that some implementations of a player selection game according to the invention may include some limit on the number of prize modification results that may be obtained in a given instance of the player selection game, and this limit would control the number of prize sets shown in a display such as that in FIGS. 11 and 12.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term). The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A gaming method including:

(a) under control on one or more processors, anonymously displaying a number of player selectable elements through a display system of a gaming machine, each player selectable element being associated with a respective selection game result in a player selection game, wherein at least one of the selection game results comprises a respective prize value included in a first set of prize values and wherein at least one respective selection game result comprises a prize modification result;

(b) receiving a number of player selection inputs through a player input system of the gaming machine, each respective player selection input selecting one of the player selectable elements which has not yet been selected;

(c) in response to each player selection input, displaying the selection game result associated with the player selectable element selected with that player selection input;

(d) in response to a first one of the player selection inputs which selects a player selectable element associated with the prize modification result, performing a first modification to modify the prize value associated with each respective player selectable element which has not yet been selected so that responsive to the first modification the prize value associated with each respective player selectable element which has not yet been selected is included in a second set of prize values made up of prize values which are each greater than the highest prize value included in the first range of prize values; and (e) through the gaming machine, awarding the prize value associated with each selected player selectable element at the time that player selectable element is selected.

2. The method of claim 1 further including in response to a second one of the player selection inputs which selects a player selectable element associated with the prize modification result, performing a second modification to modify the prize value associated with each respective player selectable element which has not yet been selected so that responsive to the second modification the prize value associated with each respective player selectable element which has not yet been selected is included in a third set of prize values made up of prize values which are each greater than the highest prize value included in the second set of prize values.

3. The method of claim 1 wherein the association between one of the player selectable elements and its associated selection game result is made dynamically.

4. The method of claim 1 further including:

(a) receiving a player input to initiate a play in a primary game, the play in the primary game being associated with a wager and the play input being received through the player input system of the gaming machine;

(b) in response to the player input to initiate the play in the primary game, displaying a primary game result for the primary game, the primary game result being displayed through the display system of the gaming machine; and (c) under the control of the one or more processors, placing the gaming machine in condition to receive the number of player selection inputs when the primary game result comprises a selection game triggering result.

5. The method of claim 1 further including, under control of the one or more processors, displaying at least two prize categories through the display system of the gaming machine, the at least two prize categories being displayed at least partially concurrently with displaying the number of player selectable elements, each prize category including an indication of a number of prize modification results obtained in the player selection game and a list of prize values available when that number of prize modification results have been obtained.

6. The method of claim 5 further including, under control of the one or more processors, for the number of prize modification results obtained at that time in the player selection game, displaying the prize category indicating that number of prize modification results in a highlighted fashion relative to each other prize category being displayed.

7. The method of claim 1 wherein the prize modification result is selected from a set of different prize modification results.

8. A gaming system including:

(a) a player input system:

(b) a display system;

(c) one or more processors; and (d) one or more memory devices storing program instructions executable by the one or more processors to:

(i) cause the display system to anonymously display a number of player selectable elements, each player selectable element being associated with a respective selection game result in a player selection game, wherein at least one of the selection game results comprises a respective prize value included in a first set of prize values and wherein at least one respective selection game result comprises a prize modification result, (ii) receive a number of player selection inputs through the player input system, each respective player selection input selecting one of the player selectable elements which has not yet been selected, (iii) in response to each player selection input, cause the display system to display the selection game result associated with the player selectable element selected with that player selection input, (iv) in response to a first one of the player selection inputs which selects a player selectable element associated with the prize modification result, perform a first modification to modify the prize value associated with each respective player selectable element which has not yet been selected so that responsive to the first modification the prize value associated with each respective player selectable element which has not yet been selected is included in a second set of prize values made up of prize values which are each greater than the highest prize value the first set of prize values, and (v) award the prize value associated with each selected player selectable element at the time that player selectable element is selected.

9. The gaming system of claim 8 wherein the program instructions are also executable by the one or more processors to, in response to a second one of the player selection inputs which selects a player selectable element associated with the prize modification result, perform a second modification to modify the prize value associated with each respective player selectable element which has not yet been selected so that responsive to the second modification the prize value associated with each respective player selectable element which has not yet been selected is included in a third set of prize values made up of prize values which are each greater than the highest prize value included in the second set of prize values.

10. The gaming system of claim 8 wherein the program instructions are also executable by the one or more processors to dynamically make the association between one of the player selectable elements and its associated selection game result.

11. The gaming system of claim 8 wherein the program instructions are also executable by the one or more processors to:

(a) receive a player input through the player input system to initiate a play in a primary game, the play in the primary game being associated with a wager;

(b) in response to the player input to initiate the play in the primary game, cause the display system to display a primary game result for the primary game; and (c) place the gaming machine in condition to receive the number of player selection inputs when the primary game result comprises a selection game triggering result.

12. The gaming system of claim 8 wherein the program instructions are also executable by the one or more processors to cause the display system to display at least two prize categories, the at least two prize categories being displayed at least partially concurrently with displaying the number of player selectable elements, each prize category including an indication of a number of prize modification results obtained in the player selection game and a list of prize values available when that number of prize modification results have been obtained.

13. The gaming system of claim 12 wherein the program instructions are also executable by the one or more processors to, for the number of prize modification results obtained at that time in the player selection game, cause the display system to display the prize category indicating that number of prize modification results in a highlighted fashion relative to each other prize category being displayed.

14. The gaming system of claim 8 wherein the prize modification result is selected from a set of different prize modification results.

15. A program product comprising one or more non-transitory computer readable storage device storing program code, the program code including:

(a) selection game program code executable to, (i) cause a display system of a gaming machine to anonymously display a number of player selectable elements, each player selectable element being associated with a respective selection game result in a player selection game, wherein at least one of the selection game results comprises a respective prize value included in a first set of prize values and wherein at least one respective selection game result comprises a prize modification result, (ii) in response to each of a number of player selection inputs, cause the display system to display the selection game result associated with the player selectable element selected with that player selection input, (iii) in response to a first one of the player selection inputs which selects a player selectable element associated with the prize modification result, perform a first modification to modify the prize value associated with each respective player selectable element which has not yet been selected so that responsive to the first modification the prize value associated with each respective player selectable element which has not yet been selected is included in a second set of prize values made up of prize values which are each greater than the highest prize value included in the first set of prize values; and (b) award program code executable to award the prize value associated with each selected player selectable element at the time that player selectable element is selected.

16. The program product of claim 15 wherein the selection game program code is also executable to, in response to a second one of the player selection inputs which selects a player selectable element associated with the prize modification result, perform a second modification to modify the prize value associated with each respective player selectable element which has not yet been selected so that responsive to the second modification the prize value associated with each respective player selectable element which has not yet been selected is included in a third set of prize values made up of prize values which are each greater than the highest prize value included in the second set of prize values.

17. The program product of claim 15 wherein the selection game program code is also executable to dynamically make the association between one of the player selectable elements and its associated selection game result.

18. The program product of claim 15 further including primary game program code executable to in response to a player input to initiate a play in a primary game, cause the display system to display a primary game result for the primary game and initiate execution of the player selection game program code when the primary game result comprises a selection game triggering result.

19. The program product of claim 15 wherein the player selection game program code is also executable to cause the display system to display at least two prize categories, the at least two prize categories being displayed at least partially concurrently with displaying the number of player selectable elements, each prize category including an indication of a number of prize modification results obtained in the player selection game and a list of prize values available when that number of prize modification results have been obtained.

20. The program product of claim 19 wherein the program code also includes prize display program code executable to, for the number of prize modification results obtained at that time in the player selection game, cause the display system to display the prize category indicating that number of prize modification results in a highlighted fashion relative to each other prize category being displayed.

* * * * *